US006095466A

United States Patent [19]

Sener et al.

[11] Patent Number: 6,095,466

[45] Date of Patent: Aug. 1, 2000

[54] MODULAR SUPPORT ASSEMBLY FOR RETAINING ACCESSORY ADAPTORS ON A STRUCTURAL MEMBER

[76] Inventors: James Sener, 240 Farmstead La., Glastonbury, Conn. 06033-3244; Sam Zeldmer, 266 Georgetown Dr., Glastonbury, Conn. 06033; Arthur D. Breault, 270 Gilead Rd., Andover, Conn. 06232

[21] Appl. No.: 09/163,224

[22] Filed: Sep. 29, 1998

[51] Int. Cl.[7] ..... A47B 96/06

[52] U.S. Cl. ..... 248/231.61; 248/219.4

[58] Field of Search ..... 248/219.4, 218.4, 248/219.3, 230.5, 228.5, 231.61, 230.1, 219.2

[56] References Cited

U.S. PATENT DOCUMENTS

| | | | |
|---|---|---|---|
| 1,777,884 | 10/1930 | Horix | 248/230.5 |
| 2,908,469 | 10/1959 | Mack et al. . | |
| 2,941,769 | 6/1960 | Alpard . | |
| 3,164,345 | 1/1965 | Menser | 248/68.1 |
| 3,212,817 | 10/1965 | Sully | 297/423.37 |
| 3,332,654 | 7/1967 | Jacobson . | |
| 3,921,949 | 11/1975 | Coon | 248/219.2 |
| 4,595,165 | 6/1986 | Klingensmith et al. | 248/539 |
| 4,735,152 | 4/1988 | Bricker | 108/97 |
| 4,997,154 | 3/1991 | Little | 248/225.31 |
| 5,193,774 | 3/1993 | Rogers | 248/219.4 |
| 5,505,416 | 4/1996 | Dodge | 248/230.5 |
| 5,727,762 | 3/1998 | Cosentino | 248/231.61 |
| 5,785,447 | 7/1998 | Fonti et al. | 403/49 |

*Primary Examiner*—Ramon O. Ramirez
*Attorney, Agent, or Firm*—McCormick, Paulding & Huber LLP

[57] ABSTRACT

A modular support assembly for retaining accessory adaptors on structural members having circular or rectangular cross sections, comprising a first clamp member and a second clamp member formed so as to accommodate an accessory adaptor and the structural member there between. An accessory adaptor is formed with a shoe member and a cantilevered portion, the shoe portion being slid into mating engagement with first claim member by insertion of a mating protrusion into a channel of first clamp member. First clamping member, including inserted shoe portion, and second clamping member are then placed on opposite sides of the structural member at a point where attachment is desired. Actuating knobs are then repeatedly turned, causing retaining devices to threadedly engage threaded recesses. Operation in this manner tightens the support assembly and thereby completes the installation of the modular support assembly.

23 Claims, 14 Drawing Sheets

MODULAR SUPPORT ASSEMBLY FOR RETAINING ACCESSORY ADAPTORS ON A STRUCTURAL MEMBER

FIELD OF THE INVENTION

This invention relates generally to devices for supporting household, recreational or utilitarian items, and deals more particularly with a clamp-type device for engaging a structural member, the device being configured to retain a plurality of accessory adaptors.

BACKGROUND OF THE INVENTION

The lack of adequate storage areas is a problem typical of most homes and businesses today. For example, renters or lessors of property tend to have a variety of implements, tools, boxes, and other items which, if no area for hanging or otherwise supporting then them is available, results in areas of clutter.

A number of attempts have been made to address this problem with varying degrees of success. For instance, prefabricated shelves can be employed; however, these shelves can be costly and often require time-consuming assembly. In addition many items such as, rakes, shovels, or oddly shaped children's toys cannot fit onto these shelves. Storage shelves can also be handmade, requiring large expenditures of time and often money.

Another storage device that can be used consists of hooks which screw into the studs or joists of the building. These hooks are only effective for supporting a limited number of items. Additionally, the damage created by their application is undesirable and may be prohibited to a renter or lessor of property.

Based on the foregoing, it is the general object of the present invention to provide a storage system that overcomes the above-described drawbacks of existing support and storage systems.

It is a more specific object of the present invention to provide a storage system wherein the load is supported by existing structural supports and the application of the system does not result in any damage to the structural supports.

SUMMARY OF THE INVENTION

The present invention is directed toward a modular support assembly for retaining accessory adaptors on a structural member such as lolly columns. The support assembly of the present invention has utility in the support and storage of various household and other items. In a preferred embodiment of the present invention, the modular support assembly includes two clamping members for releasably retaining an accessory adaptor to a lolly column. The accessory adaptor defines a shoe portion engageable with one of the clamping members and a cantilevered portion that can assume many different forms depending on the type of item the cantilevered portion is to support. Means are also provided for coupling the clamping members to the lolly column. While lolly columns have been described, the present invention is not limited in this regard as other structural members, such as pipes or wooden posts, may be substituted without departing from the broader aspects of the present invention.

To releasably retain the shoe portion, one of the clamping members defines at least one channel extending along the inner periphery of the clamping member. This channel extends at least part way through the body of the clamping member and is adapted to accept and releasably retain a mating protrusion projecting from the shoe portion.

Preferably, the means for coupling the clamping members together includes a pair of fasteners, each extending through an aperture defined by one of the clamping members and threadedly engaging the other clamping member. The preferred embodiment of the present invention also includes means for buttressing the cantilevered portion to provide for greater load-bearing capabilities of the accessory adaptor. A support may be, alternatively, either formed integrally with the cantilevered portion to provide this buttressing, or a separate support may be attached to the underside of the cantilevered portion.

In an alternate embodiment of the present invention, rather than employing a shoe with a cantilevered extension, the cantilevered section is integral with one of the clamping members.

DETAILED DESCRIPTION OF THE PREFERRED EMBODIMENTS

Figure 1:
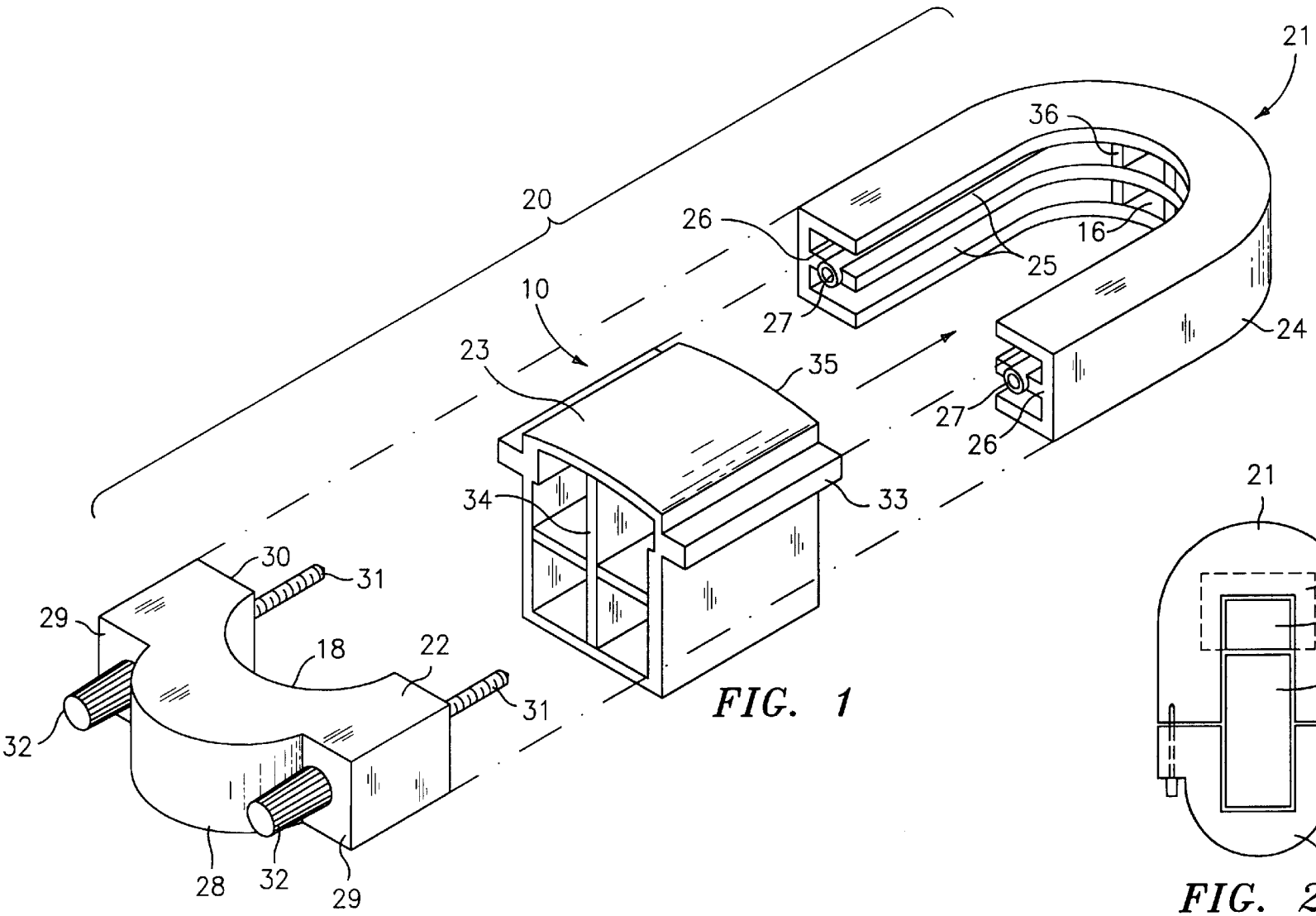
FIG. 1 is an exploded perspective view of the modular support assembly and shoe portion of the accessory adaptor, engageable with a structural member in accordance with one embodiment of the present invention.

As shown in FIG. 1 a support assembly in accordance with an embodiment of the present invention is generally designated by the numeral 20 and includes a first clamp member 21, a second clamp member 22, and an accessory adaptor generally designated by numeral 10. Accessory adaptor 10 defines a shoe portion 23 and a shaped cantilevered portion, generally designated by the numeral 15, extending from the shoe portion, and is adapted to be retained, as will be explained in detail herein below, by the first and second clamp members, 21 and 22 respectively. The first and second clamp members, 21 and 22, are in turn configured to be releasably secured to a lolly column (not shown). While a lolly column has been described, the present invention is not limited in this regard as other structural members, such as, but not limited to, pipes or rectangular wooden beams can also be employed without departing from the broader aspects of the present invention.

The first clamp member 21 defines an outer peripheral surface 24 and a corresponding inner peripheral surface 16 that defines two channels 25 extending there along, and part-way through the first clamp member 21 between the inner peripheral surface 16 and the outer peripheral surface 24. In addition, first clamp member 21 also includes a pair of abutment surfaces 26, which further define internally threaded apertures 27 that extend at least partially into the body of first clamp member 21. Additionally, while first clamp member 21 has been shown and described as defining two channels 25, the present invention is not limited in this regard, as one or a plurality channels can be employed without departing from the broader aspects of the present invention.

Similarly, and still in reference to FIG. 1, the second clamp member 22 also defines an outer peripheral surface 28 and a corresponding inner peripheral surface 18. Additionally, the second clamp member 22 further defines a pair of bosses 29 projecting outwardly from outer peripheral surface 28, a pair of matching abutment surfaces 30 (for clarity, only one of which is labeled in FIG. 1), a pair of threaded fasteners 31, and a pair of hand knobs 32 that correspond to each threaded fastener 31 for operation thereof The hand knobs 32 and the threaded fasteners 31 are oriented as shown in FIG. 1 so that when the first and second clamp members, 21 and 22 respectively, are properly positioned on a lolly column, the abutment surfaces 26 of the first clamp member 21, and matching abutment surfaces 30 are engaged. With the first and second clamping members 21 and 22 engaged, the threaded fasteners 31 extend through each boss 29 to threadedly engage with corresponding integrally threaded apertures 27 to thereby releasably secure the first and second clamp members 21 and 22 to the lolly column. As shown in FIG. 1, the threaded fasteners 31 are described, however, the present invention is not limited in this regard as other types of fasteners, such as socket heads, cap screws, or bolts may be substituted without departing from the broader aspects of the present invention. In addition, while hand knobs 32 are also shown and described, the present invention is not limited in this regard as handles may be substituted without departing from the broader aspects of the present invention.

Still in reference to FIG. 1, the accessory adaptor 10 of the present invention includes a shoe portion 23, and a cantilevered portion 15. The shoe portion 23 defines at least one mating protrusion 33 which is adapted to be received by the channel 25 defined by the first clamp member 21. In addition, the shoe portion 23 defines a front face 34 that contacts with the structural member when support assembly 20 is releasably secured to the structural member, and a back face 35 adapted to seat against the inner peripheral surface 16 of the first clamp member 21. While front face 35, and the inner peripheries, 16 and 18, of the first and second clamp members 21 and 22, respectively, have been illustrated as being arcuate, the present invention is not limited in this regard, as the shape can be square, rectangular, or any other geometric configuration, without departing from the broader aspects of the present invention. In addition, while FIG. 1 illustrates a single mating protrusion 33, the shoe portion 23 may also include two or more mating protrusions, without departing from the broader aspects of the present invention.

As further illustrated in FIG. 1, shoe portion 23 need not be formed with a solid body structure, but can instead have a honeycomb design to reduces material costs and manufacturing waste. Channels 25 may also have, along at least a portion of each channel, upstanding baffles 36 formed therein. In this case, mating protrusion, or protrusions, 33 will no longer be continuously formed, but rather will extend along at least the sides of shoe portion 23 for selective and releasable engagement within channels 25.

To releasably secure the support assembly 20 to the structural member, the mating protrusion 33 of the shoe portion 23 is slidably engaged with the channel 25. The first clamping member 21, including the shoe portion 23 inserted therein, and the second clamping member 22 are placed on opposite sides of the structural member at a point where attachment is desired. Knobs 32 on the fasteners 31 are next rotated to threadedly engage the internally threaded apertures 27, thereby releasably securing support assembly 20 to the structural member.

Figure 2:
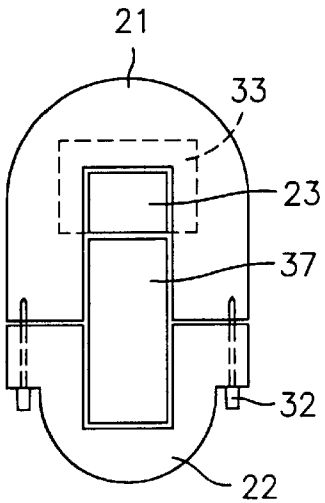
FIG. 2 is a plan view of the modular support assembly and accessory adaptor, for use with a rectangular structural member shown in cross section, in accordance with another embodiment of the present invention.

Turning to FIG. 2, the support assembly 20 is illustrated to be coupled to a rectangular structural member 37 such as a wooden beam. To accomplish this, the inner peripheral surfaces, 16 and 18 respectively, of the first clamp member 21 and the second clamp member 22 are also rectangular as are the front face 34 and the back face 35 of the shoe portion 23. The support assembly 20 is releasably secured to the structural member as detailed above. It will be readily appreciated that the support assembly 20 of the present invention provides for a simple and efficient installation process which does not damage the structural member upon which it is affixed.

As is illustrated in FIGS. 3–17, cantilevered portion 15 may assume several different forms.

Figure 3:
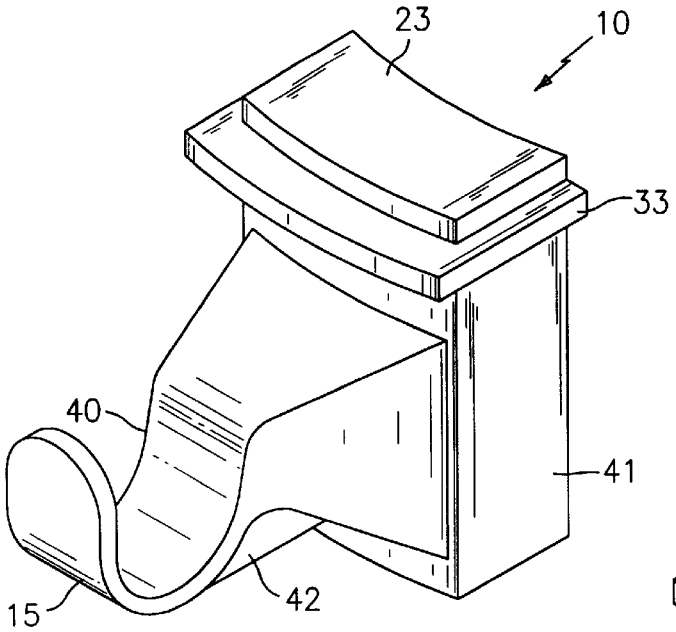
FIG. 3 is a perspective view of an accessory adaptor having a cantilevered portion in the shape of a hook, in accordance with another embodiment of present invention.
Figure 4:
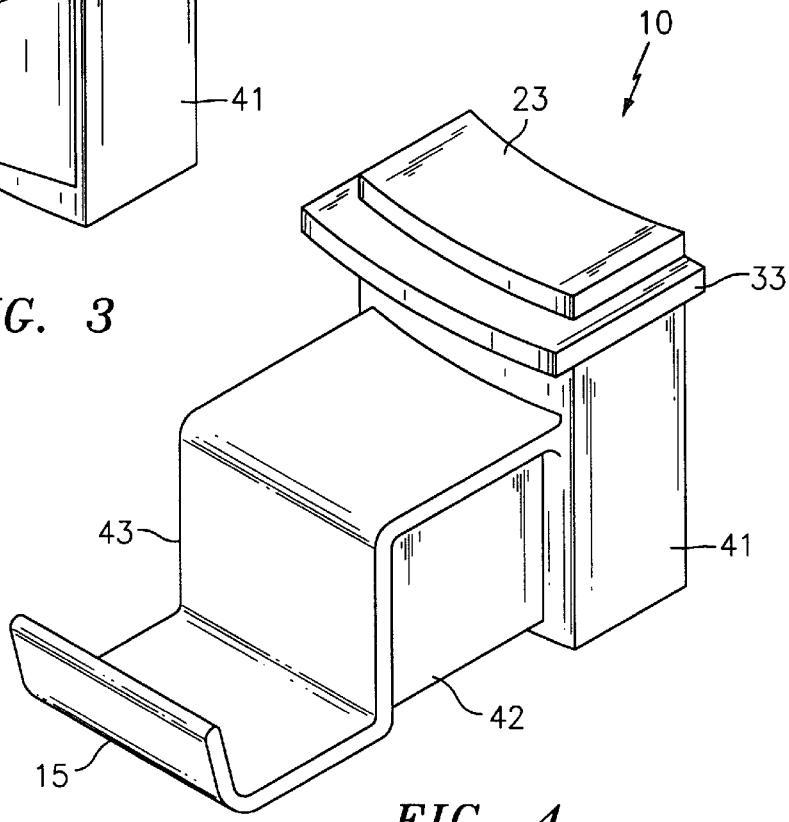
FIG. 4 is a perspective view of another embodiment of the accessory adaptor having a cantilevered portion in the shape of an angled hook, in accordance with another embodiment of the present invention.
Figure 4A:
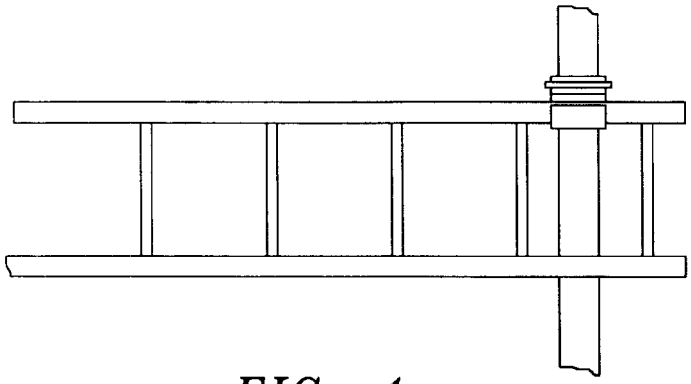

As shown in FIG. 3, the cantilevered portion 15 of accessory adaptor 10 is a hook 40 that is used to hang all manners of items therefrom. A collar portion 41 extends from the shoe portion 23 and is integral with the cantilevered portion 15. The collar portion 41 is adapted to conform to the geometric configuration of a particular structural member. The accessory adaptor 20 may also include molded ribs 42 which extend from the underside of hook 40, so as to impart greater load bearing capability to the cantilevered portion 15. The hook 40 can assume various different geometric configurations, for example, the hook can define a rectangular channel 43, as illustrated in FIG. 4, such that a pair of support assemblies 20 may be mounted to two spaced apart structural members to support longer items, such as a ladder, as illustrated in FIG. 4*a*. Additional molded ribs 42 may also be formed on the underside of rectangular channel 43, so as to impart greater load bearing capabilities to the cantilevered portion.

Figure 5:
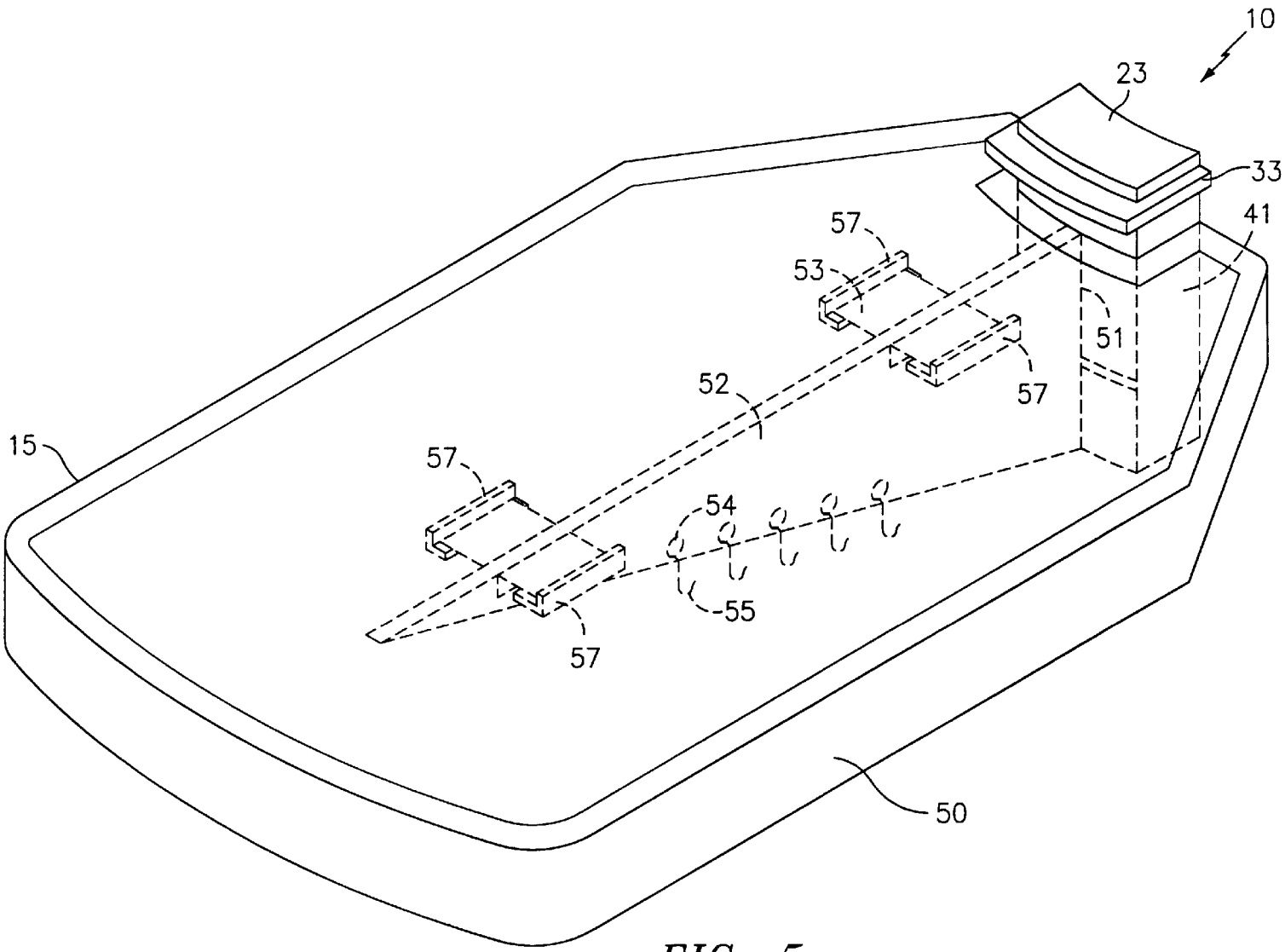
FIG. 5 is a perspective view of another embodiment of the accessory adaptor having a cantilevered portion in the shape of a generally rectangular shelf, in accordance with another embodiment of the present invention.
Figure 6:
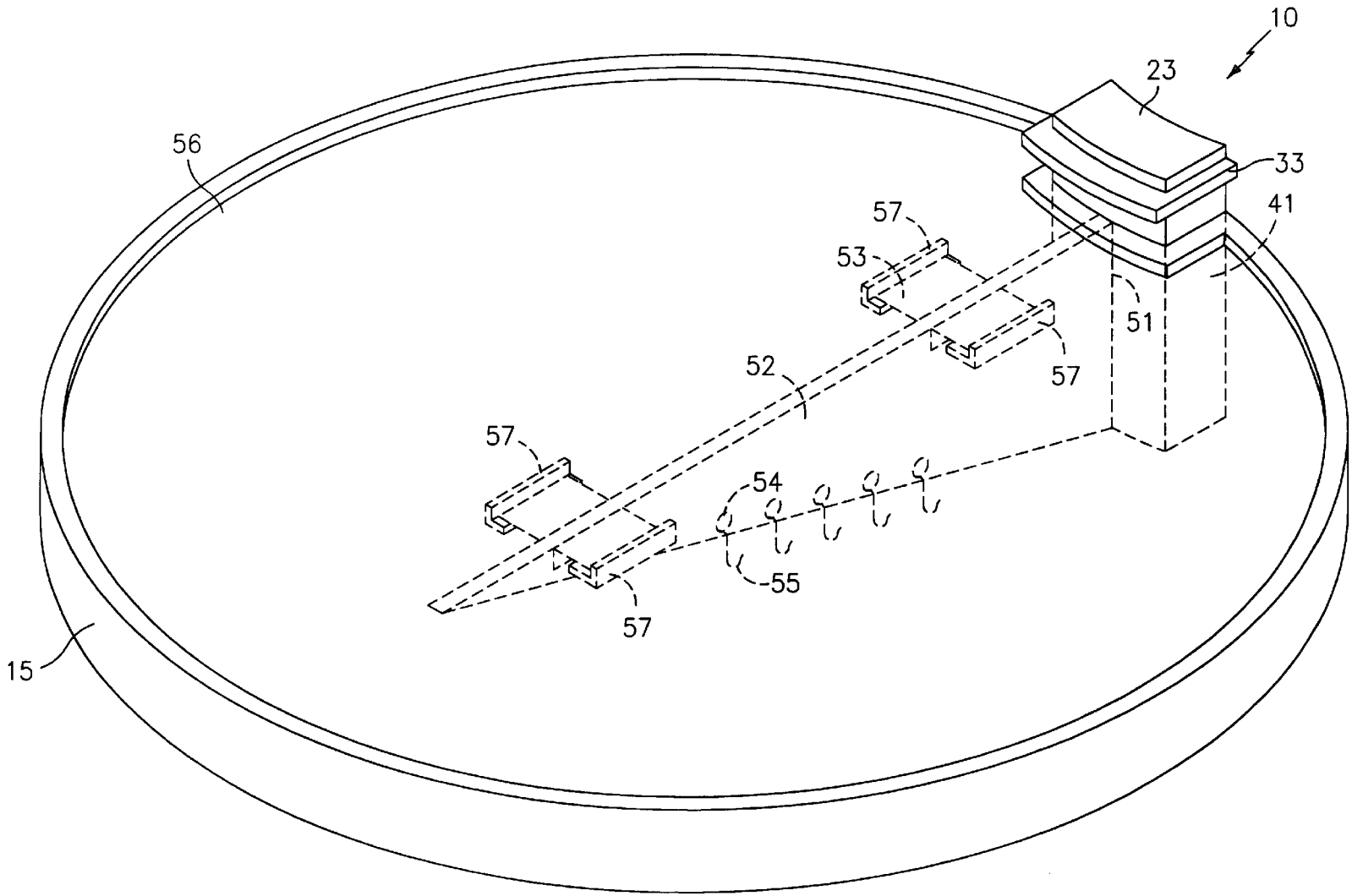
FIG. 6 is a perspective view of another embodiment of the accessory adaptor having a cantilever portion in the shape of a generally circular shelf, in accordance with another embodiment of the present invention.

FIG. 5 shows another embodiment of the accessory adaptor 10 wherein the cantilevered portion forms a generally rectangular shelf 50. As discussed above, the shoe portion 23 includes a downwardly extending collar 41 shaped to conform to the geometric configuration of a particular structural member. The collar portion 41 defines a groove 51. In this embodiment, the groove 51 seats one edge portion of a gusset 52. The gusset 52 is utilized so as to impart greater load bearing capabilities to the shelf 50. Securing tabs 53 are attached to an upper edge portion of the gusset 52. The underside of shelf 50 includes downwardly projecting brackets 57 adapted to slidably receive and releasably return the shelf 50. The gusset 52 may additionally define one or more apertures 54 each for accepting a hook 55 adapted to provide a mechanism for the suspension and storage of items therefrom. While the illustrated embodiment shows a rectangular shelf, the present invention is not limited in this regard as other shaped shelves, such as shelf 56 shown in FIG. 6, can be substituted without departing from the broader aspects of the present invention.

Figure 7:
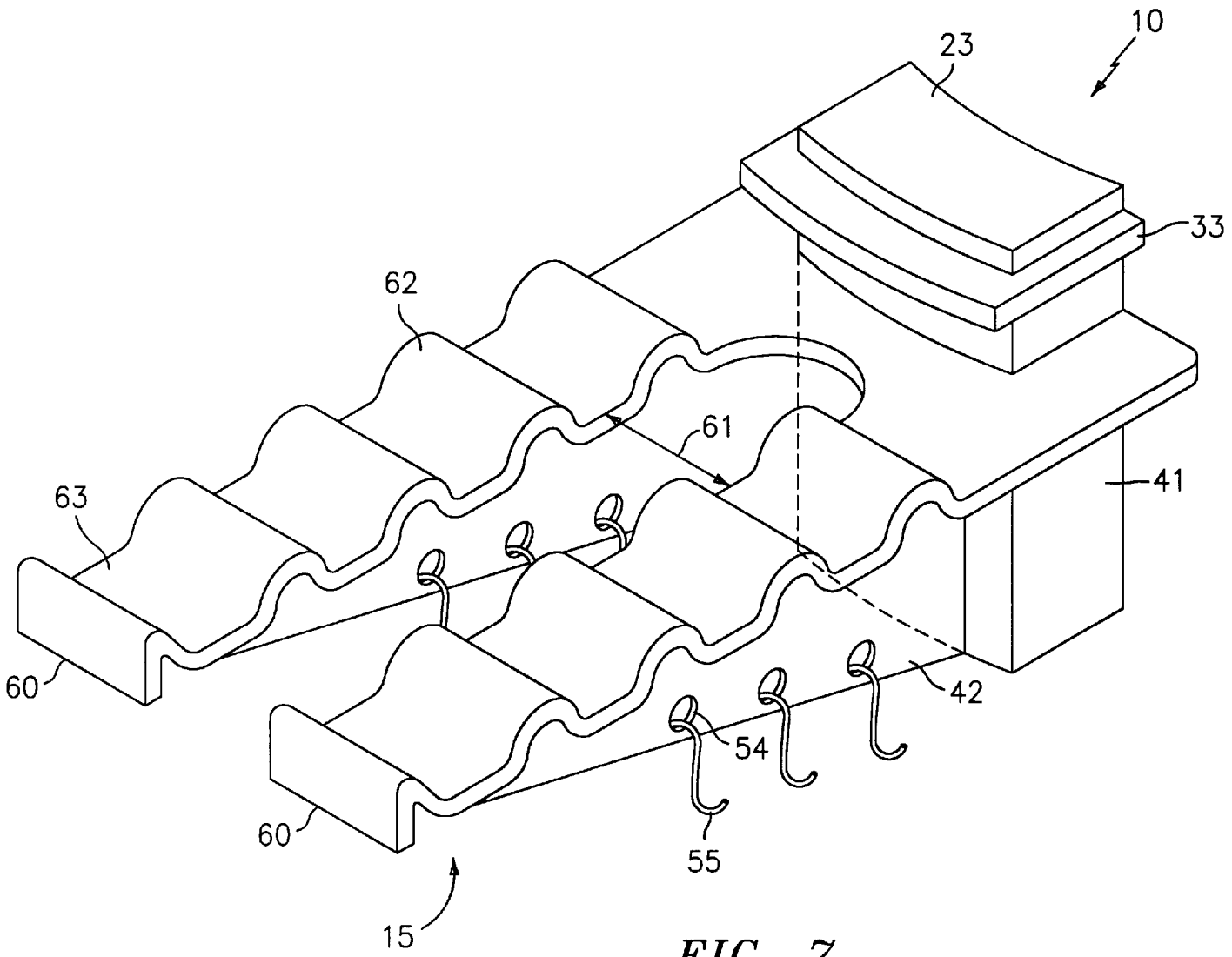
FIG. 7 is a perspective view of another embodiment of the accessory adaptor having a cantilevered portion adapted to suspend garden or lawn implements, in accordance with another embodiment of the present invention.

As shown in FIG. 7, another embodiment of the accessory adaptor 10 includes two approximately parallel elongated sections 60 defining a gap 61 there between. Each elongated section 60 further defines a plurality of raised portions 62 and corresponding recessed portions 63, adapted to receive and support various accessories such as a rake and/or shovels. Molded ribs 42 are also formed on the underside of each elongated section 60, so as to impart greater load carrying capability to the cantilevered portion 15. Additionally, the molded ribs 42 may also define at least one, and preferably more than one, aperture 54 each for accepting a hook 55 adapted to provide a mechanism for the suspension and storage of items therefrom. It will be readily appreciated that elongated sections of all shapes, sizes and dimensions, including gaps of differing widths, are contemplated by the present invention, for selective accommodation of various accessories.

Figure 8:
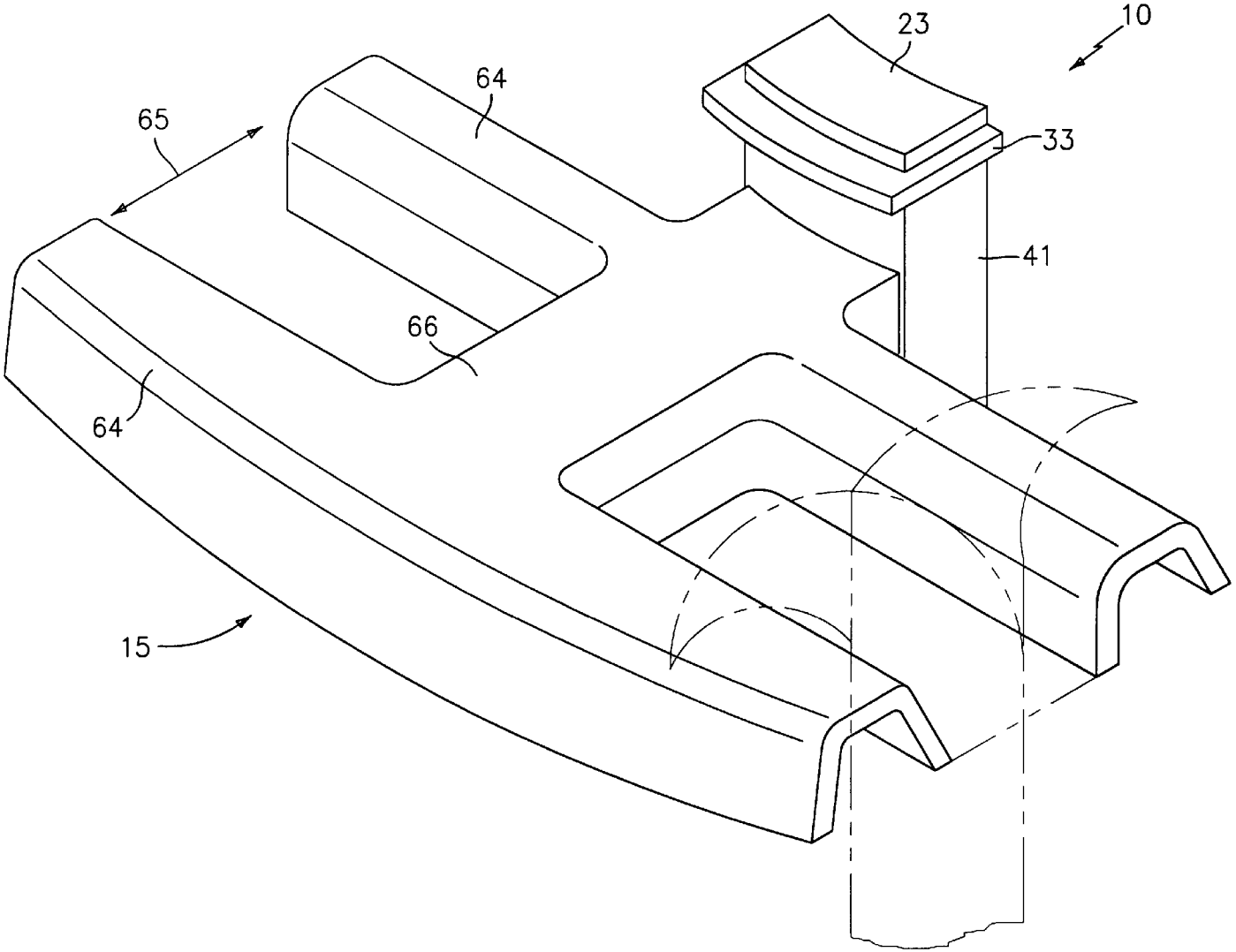
FIG. 8 is a perspective view of another embodiment of the accessory adaptor having a cantilevered portion adapted to suspend at least one pair of skis, in accordance with another embodiment of the present invention.

Still another embodiment of the accessory adaptor 10 is shown in FIG. 8. In this embodiment, the cantilevered portion 15 defines two pairs of approximately parallel elongated sections 64. The elongated sections 64 define a gap 65 there between to support a pair of skis. Although not illustrated in FIG. 8, ribs 42 may also be formed on the underside of center section 66, so as to impart greater load carrying capability to the cantilevered portion 15. Additionally, the molded ribs 42 may define at least one, and preferably more than one, aperture 54 each for accepting a hook 55 adapted to provide a mechanism for the suspension and storage of items therefrom. It will be readily appreciated that elongated sections of all shapes, sizes and dimensions, including gaps of differing widths, are contemplated by the present invention, for selective accommodation of various accessories.

Figure 9:
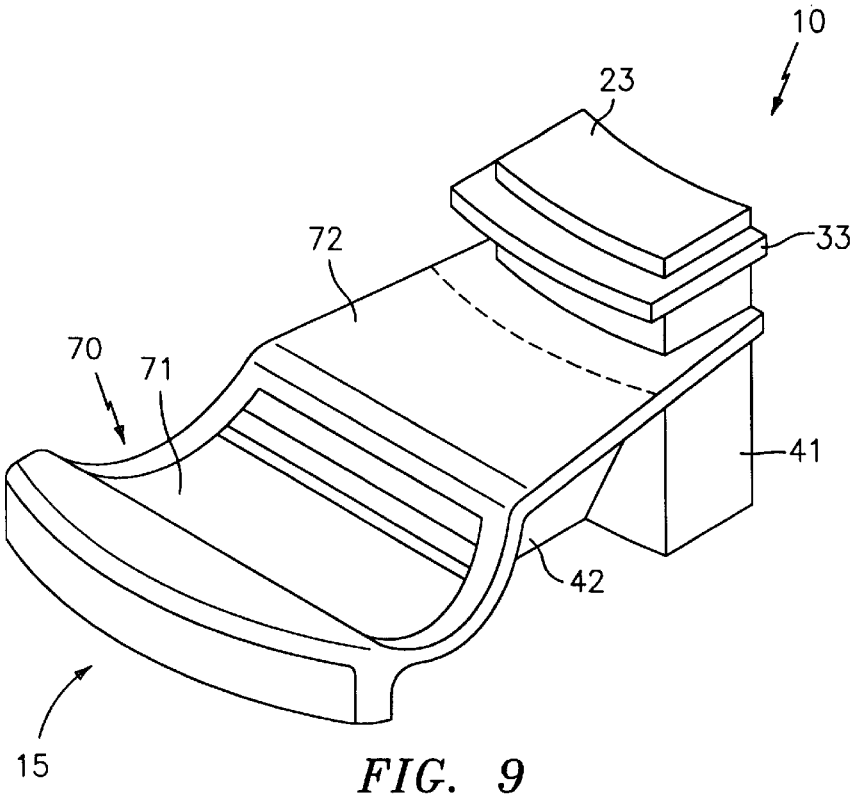
FIG. 9 is a perspective view of another embodiment of the accessory adaptor having a cantilevered portion adapted to suspend a bicycle, in accordance with another embodiment of the present invention.
Figure 10:
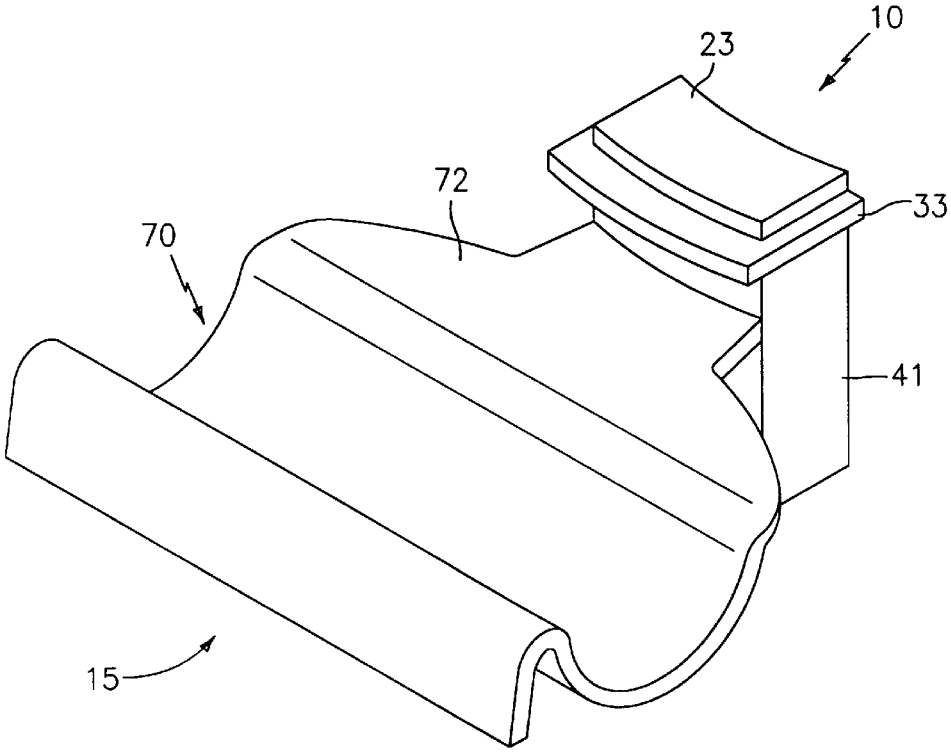
FIG. 10 is a perspective view of another embodiment of the accessory adaptor having a cantilevered portion adapted to suspend lawn furniture, in accordance with another embodiment of another present invention.

FIGS. 9 and 10 show two more alternative embodiments of the accessory adaptor 10 wherein the cantilevered portion 15 defines trough 70. As illustrated in FIG. 9, trough 70 may have padding 71 adhered by glue, epoxy or the like, to the inside surface thereof. In this embodiment, trough 70 can be utilized to hang items such as a bicycle, whereby the padding 71 acts to prevent undesirable wear upon the bicycle frame. Ribs 42 may also be formed on the underside of neck portion 72 (not shown in FIG. 10), so as to impart greater load bearing capability to the cantilevered portion 15. It will be readily appreciated that troughs of all shapes, sizes and dimensions are contemplated by the present invention, for selective accommodation of various accessories.

Figure 11:
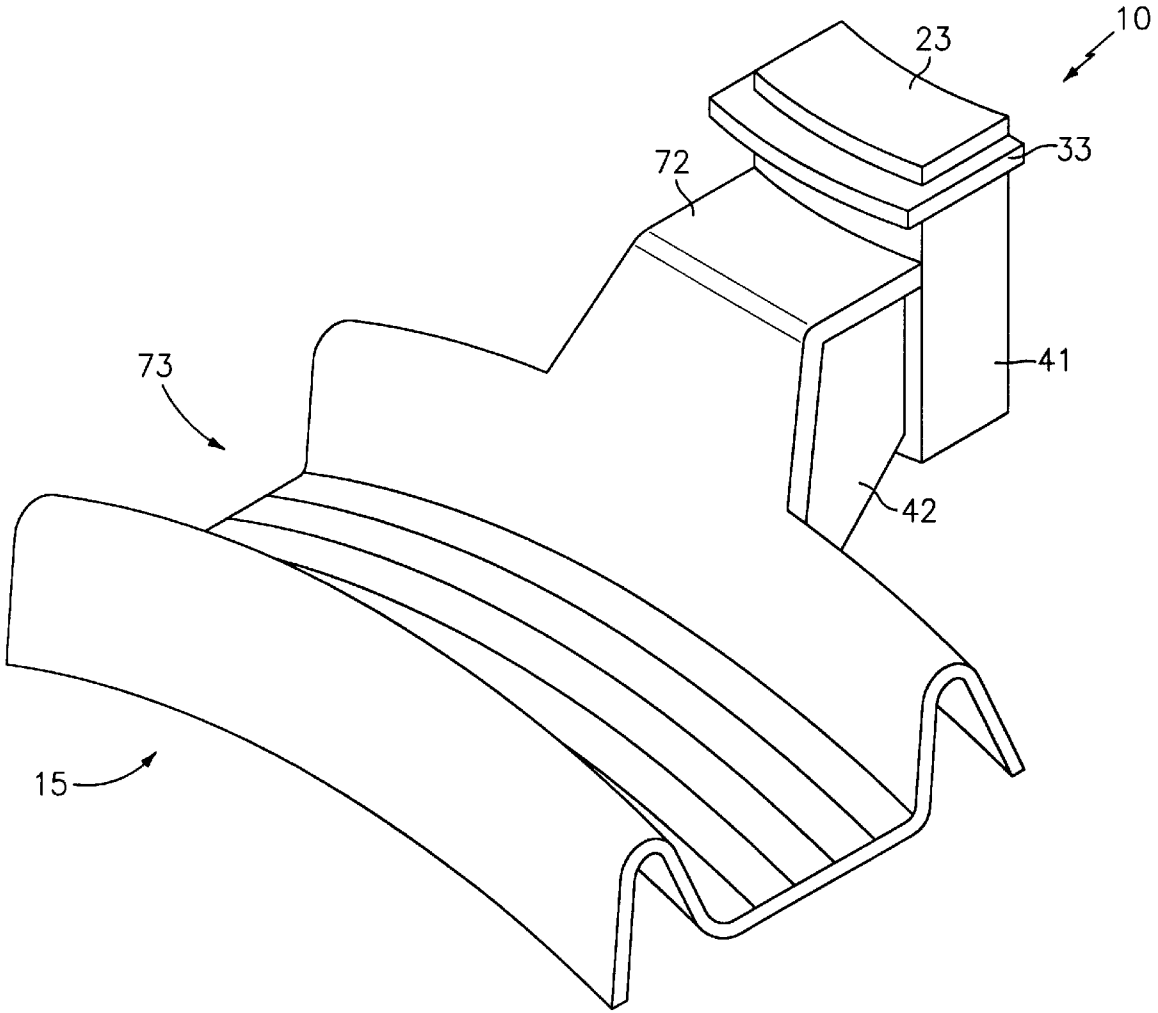
FIG. 11 is a perspective view of another embodiment of the accessory adaptor having a cantilevered portion adapted to suspend a hose, rope, wire or cord, in accordance with another embodiment of the present invention.

FIG. 11 shows still another embodiment of the accessory adaptor 10 wherein the cantilevered portion 15 defines a neck portion 72 extending outwardly to a convex trough 73. The convex trough 73 is adapted to retain items such as a garden hose, electrical cords or rope.

Figure 12:
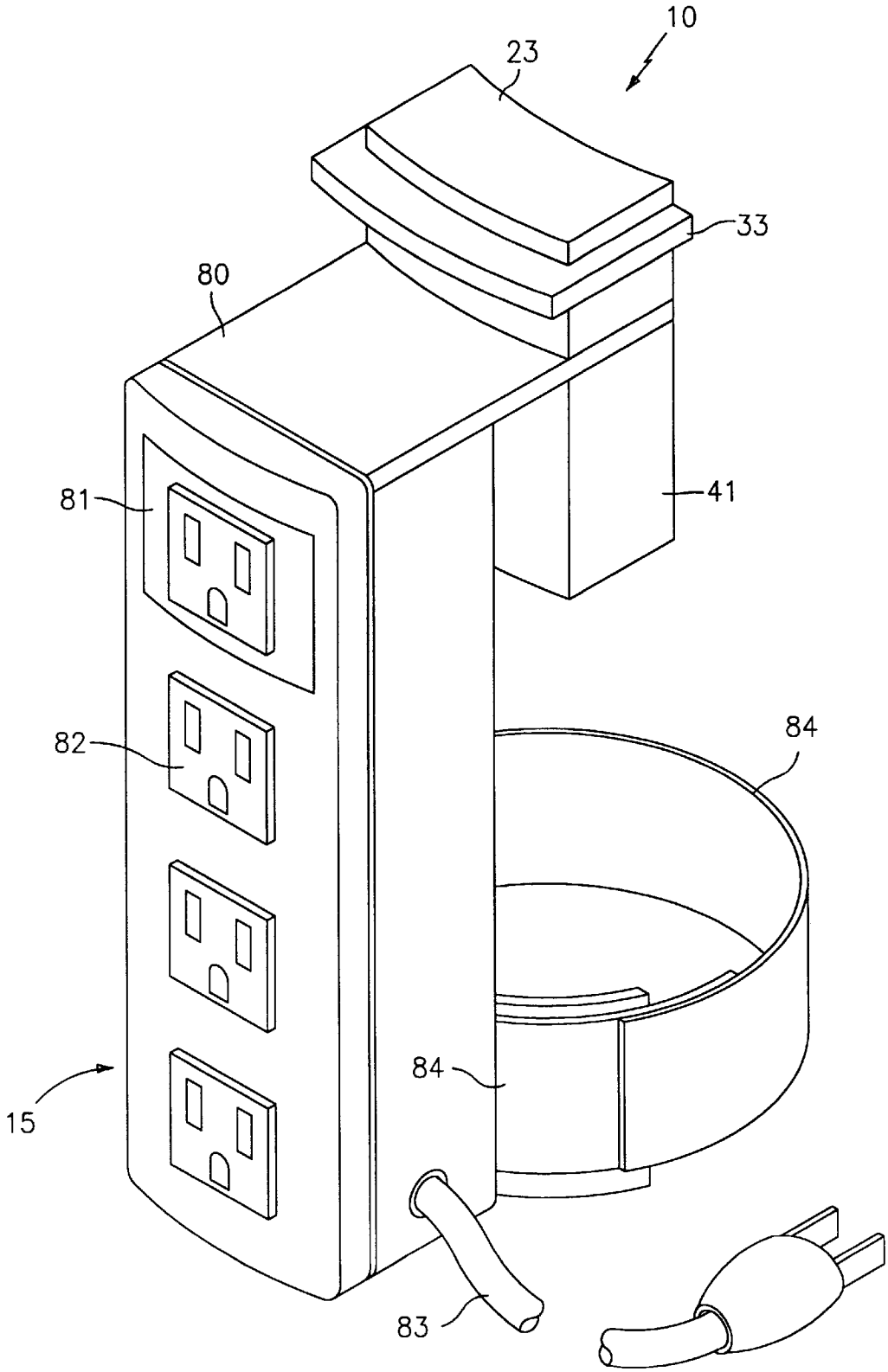
FIG. 12 is a perspective view of another embodiment of the accessory adaptor having a cantilevered portion adapted to house electrical devices, in accordance with another embodiment of the present invention.
Figure 13:
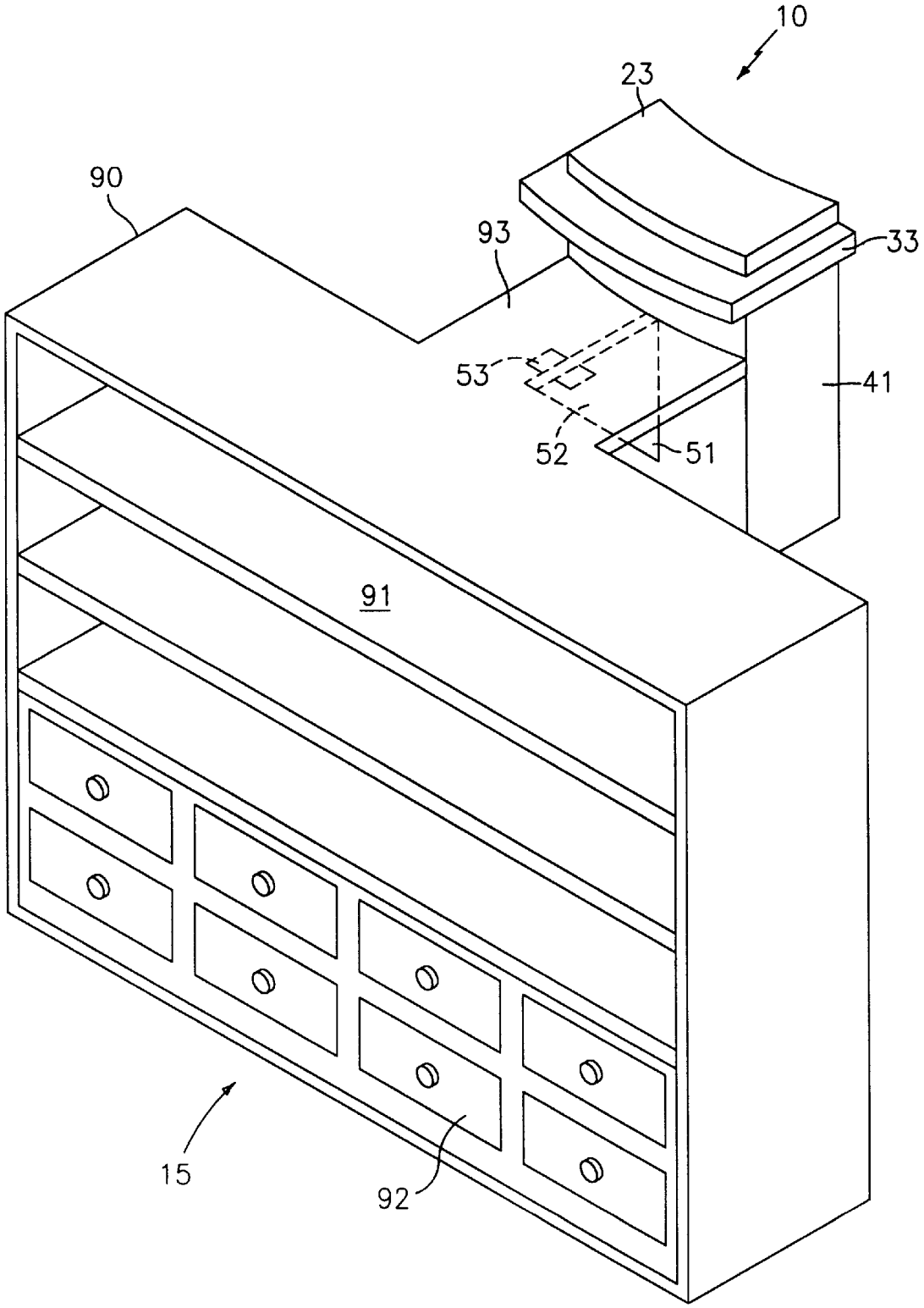
FIG. 13 is a perspective view of another embodiment of the accessory adaptor having a cantilevered portion adapted to house a plurality of drawers and shelves, in accordance with another embodiment of the present invention.

FIG. 12 shows still another embodiment of the accessory adaptor 10 wherein the cantilevered portion 15 defines an electrical housing 80 adapted to receive at least one, and preferably a plurality of, electrical devices such as a work light 81, an electrical outlets 82, or an electrical power cord 83. The power cord 83 is operatively connected to the electrical devices 81 and 82, and is capable of connection to a power source such as a wall plug to provide power to the electrical devices. The housing is further formed with a securing slot 84 for accommodating a securing strap 85. The securing strap 85 extends through the slot 84 and around the structural member to help fasten the housing 80 thereon. It will be readily appreciated that any commonly known fastening means may be employed, such as a snap, a buckle, Velcro®, or the like. FIG. 13 shows the cantilevered portion 15 defining a neck portion 93 extending outwardly to a housing 90 adapted to receive at least one, and preferably a plurality of shelves 91 or utility drawers 92. In this embodiment, the collar portion 41 defines a groove 51 adapted to receive an edge portion of a gusset 52. The gusset 52 imparts greater load bearing capabilities to the housing 90 and is selectively attached to the underside of the neck portion 93 by securing tabs 53. The tabs 53 may be fixed to the underside of neck portion 93 by any number of conventional adhering means, such as by glue, epoxy or screws.

Figure 14:
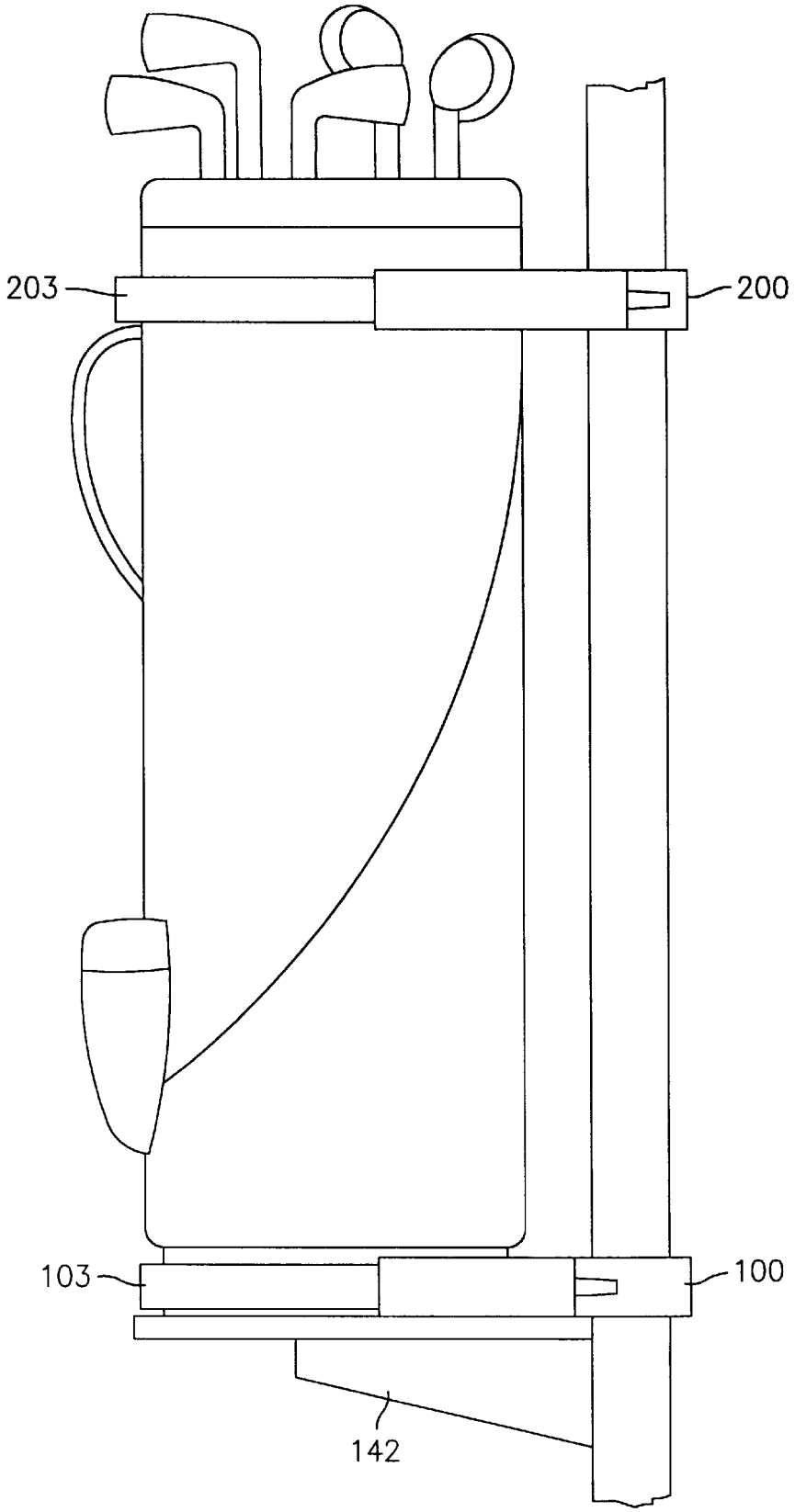
FIG. 14 is a side elevational view of an embodiment of the accessory adaptor, for supporting a bag of golf clubs, having upper and lower adaptor portions, in accordance with another embodiment of the present invention.

FIG. 14 shows yet another embodiment of the accessory adaptor 10, comprised of a base portion 100, a top portion 200, and securing straps 103/203. In this embodiment, the base portion 100 and the top portion 200 work together as a pair to suspend a bag of golf clubs from a structural member. As illustrated in FIG. 14, the base portion 100 and the top portion 200 are releasably secured to a structural member.

Figure 15:
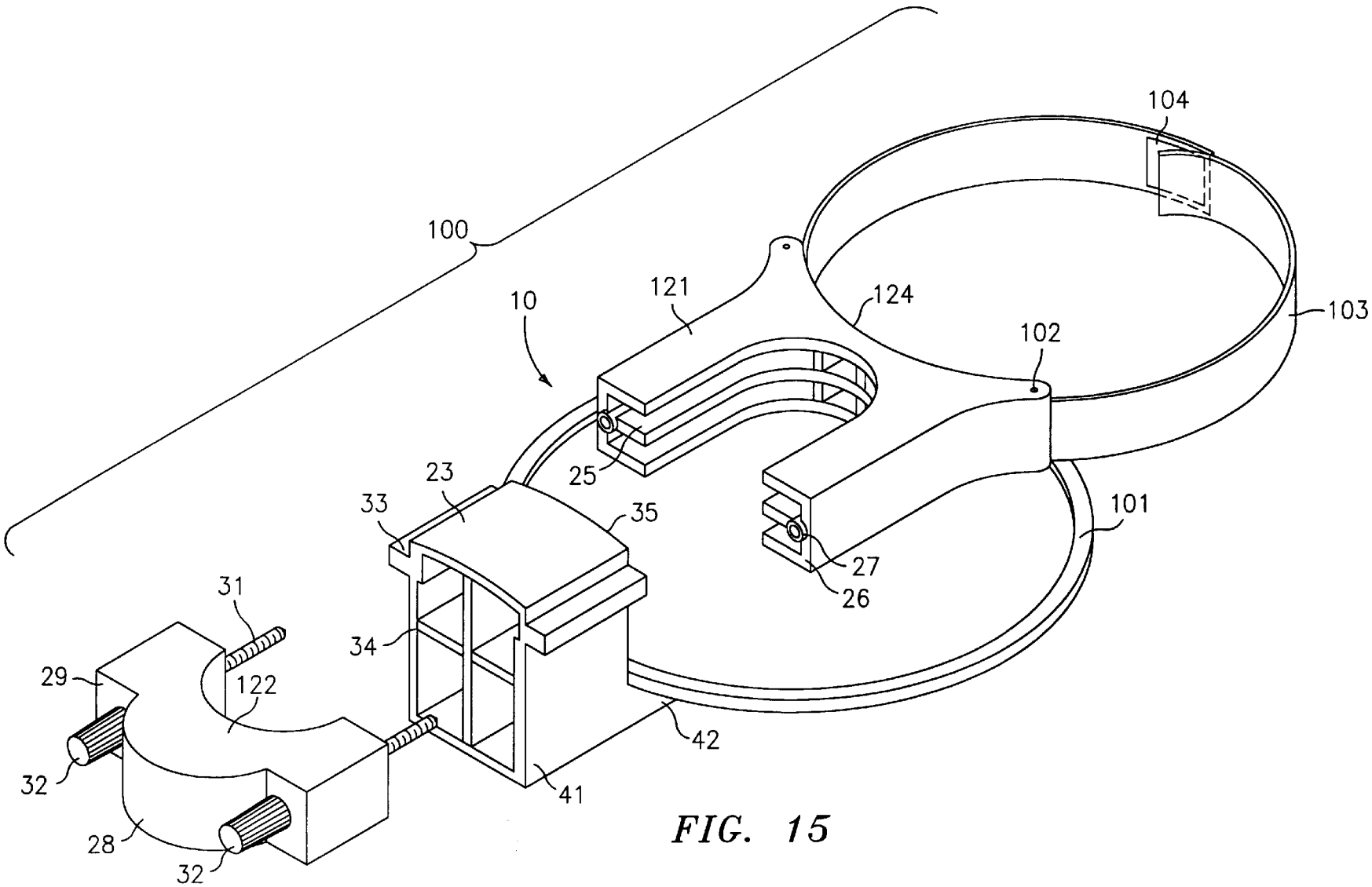
FIG. 15 is a perspective view of the lower adaptor portion of the accessory adaptor of FIG. 14.

Elements of FIGS. 15 and 16 which are formed consistent with the disclosure of FIGS. 1–13 will be given identical numerical designations and will not again be described. The first clamp member 121 of the base half 100 defines an outer peripheral surface 124 adapted to conform to the exterior of a golf bag and is in contact thereof when the accessory adaptor 10 of this embodiment is in use. The first clamp member 121 includes securing pins 102, upon which the securing straps 103, preferably made from a suitable material such as nylon, are rotatably attached. The securing straps 103 are releasably attached to each other via patch 104, preferably made from Velcro®, to thereby encompass a golf bag. Additionally, while FIG. 15 illustrates two channels 25, first clamp member 121 may easily be manufactured to define either one or a plurality of channels without departing from the broader aspects of the present invention.

The shoe portion 23 includes an integral cantilevered portion 101, upon which the golf bag is supported.

Figure 16:
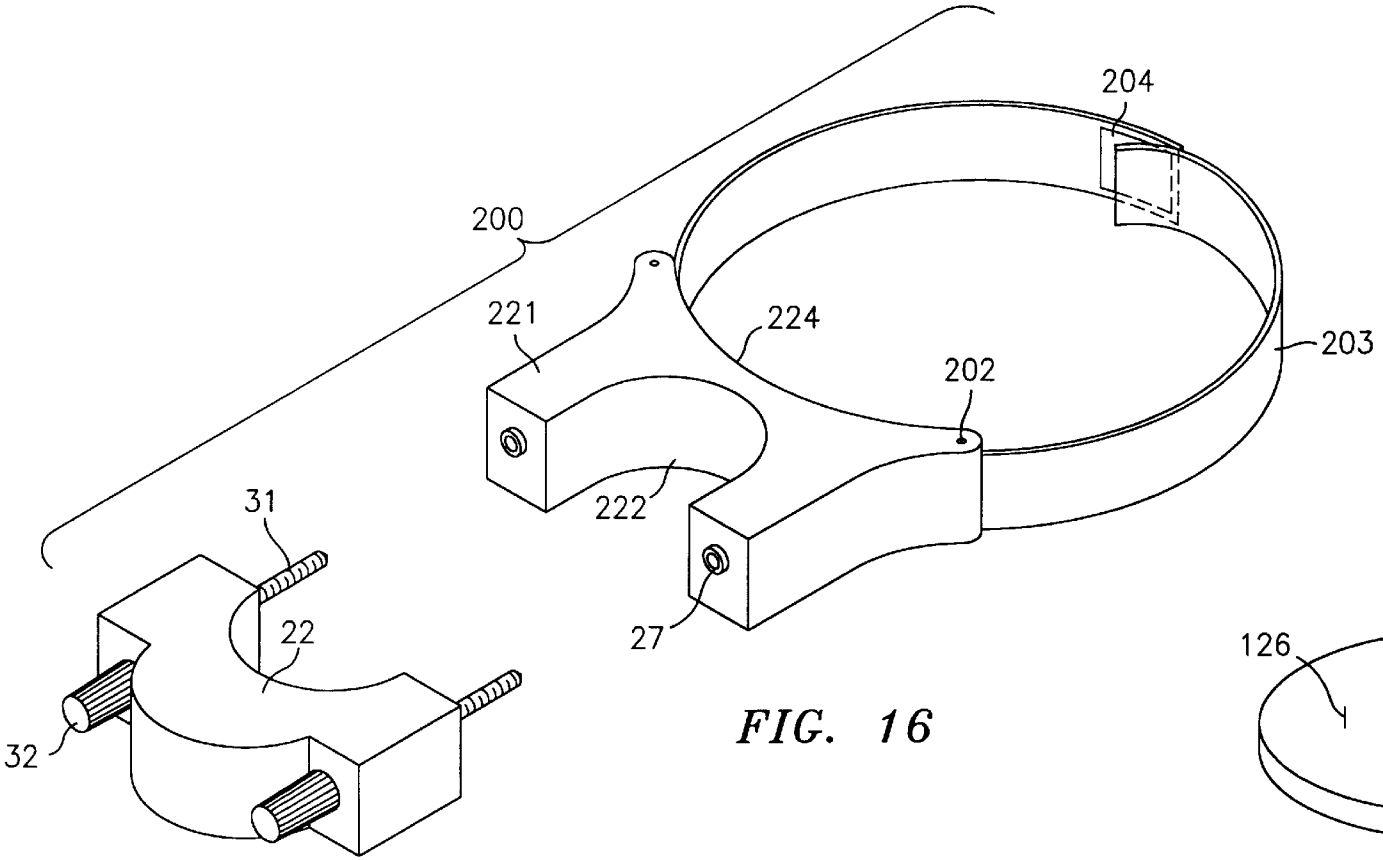
FIG. 16 is a perspective view of the upper adaptor portion of the accessory adaptor of FIG. 14.

As shown in FIG. 16, the top portion 200 defines an outer peripheral surface 224, adapted to conform to the exterior of the golf bag and is in contact thereof when the accessory adaptor 10 of the present embodiment is in use. The first clamp member 221 of the top portion 200 also defines securing pins 202, upon which securing straps 203 are rotatably attached. The securing straps 203 are releasably attached to each other via patch 204, preferably made from Velcro®, to thereby encompass a golf bag. It should be noted that the second clamp member 221 of the top half 200 defines an inner peripheral surface 222 which does not have any channels inscribed therein. This is due to the lack of any need for an accessory adaptor, as top half 200 is merely used to assist in the stabilization of the golf bag in a substantially upstanding and straightened manner.

While the first clamp members 121 and 221, the second clamp members 122 and 222 have been illustrated as being arcuate, the present invention is not limited in this regard, as their shape can be square, rectangular, or any other geometric configuration, without departing from the broader aspects of the present invention.

Figure 17:
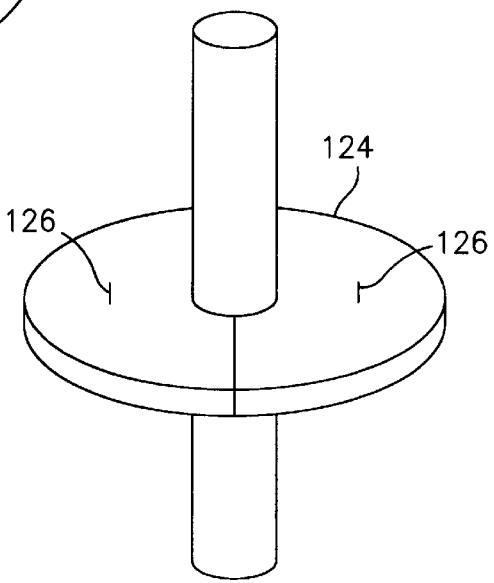
FIG. 17 is a perspective view of an embodiment of the accessory adaptor that forms a shelf encompassing the structural member.

Turning to FIG. 17, an embodiment of the support assembly 10 includes a shelf generally designated as 124. The shelf 124 is comprised of two halves 126 that extend from a shoe portion 128. Each shelf half 126 spans approximately 180° such that the two halves encompass the structural member. While the shelf halves 126 have been shown and described as extending from a shoe portion, the present invention is not limited in this regard as the shelf halves can be formed integrally with the clamp members. In addition, while the shelf halves have been illustrated as being circular, shapes such as square, rectangular, or other shapes can be substituted without departing from the broader aspects of the present invention.

Figure 18:
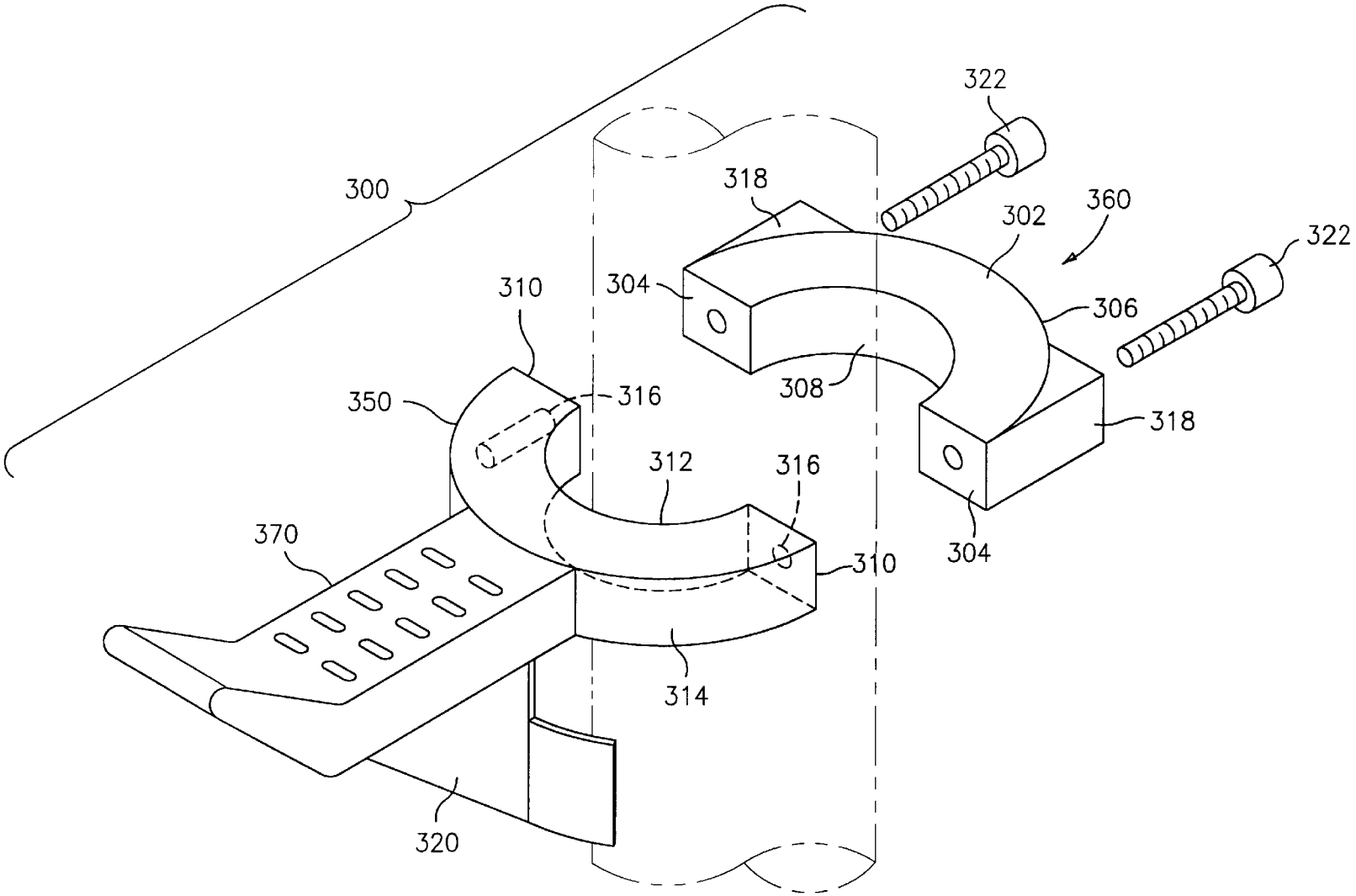
FIG. 18 is an exploded perspective view of a two piece modular support assembly, engageable with a structural member, in accordance with an alternative embodiment of the present invention.

As shown in FIG. 18 a support assembly in accordance with an alternative embodiment of the present invention is generally designated by the numeral 300 and includes a first clamp member 350 and a second clamp member 360. The first and second clamp members, 350 and 360, are configured to be releasably secured to a lolly column (shown by hidden dashed lines). While a lolly column has been described, the present invention is not limited in this regard as other structural members, such as, but not limited to, pipes or rectangular wooden beams can also be employed without departing from the broader aspects of the present invention.

The first clamp member 350 defines an outer peripheral surface 314 and a corresponding inner peripheral surface 312. In addition, first clamp member 350 also includes a pair of abutment surfaces 310, which further define internally threaded apertures 316 that extend at least partially into the body of first clamp member 350. Additionally, while first clamp member 350 has been shown and described as defining two internally threaded apertures 316, the present invention is not limited in this regard, as a nut or other commonly known threaded hardware may be imbedded within the body of the first clamp member 350 without departing from the broader aspects of the present invention.

Similarly, and still in reference to FIG. 18, the second clamp member 360 also defines an outer peripheral surface 306 and a corresponding inner peripheral surface 308. Additionally, the second clamp member 360 further defines a pair of bosses 318 projecting outwardly from outer peripheral surface 306, a pair of matching abutment surfaces 304 and a pair of hand actuated threaded fasteners 322. The hand actuated threaded fasteners 322 are oriented as shown in FIG. 17 so that when the first and second clamp members, 350 and 360 respectively, are properly positioned on a lolly column, the abutment surfaces 310 of the first clamp member 350, and matching abutment surfaces 304 are engaged. With the first and second clamping members 350 and 360 engaged, the threaded fasteners 322 extend through each boss 318 to threadedly engage with corresponding integrally threaded apertures 316 to thereby releasably secure the first and second clamp members 350 and 360 to the lolly column. The threaded fasteners 322 are described, however, the present invention is not limited in this regard as other types of fasteners, such as socket heads, cap screws, or bolts may be substituted without departing from the broader aspects of the present invention.

The outer peripheral surface 314 of the first clamp member 350 further defines a cantilevered portion 370. The cantilevered portion 370 extends outwardly from outer peripheral surface 314 and is formed integrally with at least one support rib 320 so as to impart greater load bearing capability to the cantilevered portion 370. While the inner peripheries, 312 and 308, of the first and second clamp members 350 and 360, respectively, have been illustrated as being arcuate, the present invention is not limited in this regard, as the shape can be square, rectangular, or any other geometric configuration, without departing from the broader aspects of the present invention. In addition, while FIG. 17 illustrates a single cantilevered portion 370, outer peripheral surface 314 may also include two or more cantilevered portions, without departing from the broader aspects of the present invention.

To releasably secure the support assembly 300 to the structural member the first clamping member 350, including the integrally molded cantilevered portion 370 and support rib 320, and the second clamping member 360 are placed on opposite sides of the structural member at a point where attachment is desired. Hand actuated threaded fasteners 322 are next rotated to threadedly engage the internally threaded apertures 316, thereby releasably securing support assembly 300 to the structural member.

It will be readily appreciated that the support assembly 300 of the present invention provides for a simple and efficient installation process which does not damage the structural member upon which it is affixed.

As is further illustrated in FIG. 18, cantilevered portion 370 is formed as a hook extension that is used to hang all manners of items therefrom, however, the present invention is not limited in this regard as a plethora of differently shaped cantilevered portions may be substituted without departing from the broader aspects of the present invention. In particular, the cantilevered portion 370 may at least take the shape of previously described cantilevered portions, as seen in FIGS. 3–16 in conjunction with previous embodiments of the present invention.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A modular support assembly for retaining accessory adaptors on a structural member, the adaptors each having a shoe portion defining at least one protrusion extending therefrom and a cantilevered portion projecting away from the shoe portion, the modular support assembly comprising:

a first clamp member having an inner peripheral surface, an outer peripheral surface, and defining at least one channel extending from said inner peripheral surface at least part-way through said first clamp member, said first clamp member further defining at least two abutment surfaces, the at least one channel for receiving the protrusion of the accessory adapter for positioning the accessory adaptor substantially inwardly of the inner peripheral surface and against the structural member;

a second clamp member having an inner and outer peripheral surface and defining at least two abutment surfaces adapted to engage the abutment surfaces defined by said first clamp member; and retaining means for clamping said first and second clamp members to said structural member, and for causing said abutment surfaces defined by each clamp member to engage one another thereby releasably retaining said shoe portion in clamping engagement with said structural member to keep said accessory adaptor supported in a firmly fixed position against the structural member and such that the structural member and accessory adaptor supported thereagainst are substantially interposed between the first and second clamp members.

2. The modular support assembly for retaining accessory adaptors on a structural member as defined by claim 1, wherein:

said retaining means includes at least one fastener extending through one of said first and second clamp members and threadably engaged with the other of said first and second clamp members.

3. The modular support assembly for retaining accessory adaptors on a structural member as defined by claim 2, wherein:

said second clamp member defines two opposing bosses projecting outwardly therefrom, each defining an aperture adapted to receive one of said fasteners.

4. The modular support assembly for retaining accessory adaptors on a structural member as defined by claim 2, wherein:

said inner periphery of said first and second clamp members and said channel are circular;

said mating protrusion defined by said shoe portion is arcuate.

5. The modular support assembly for retaining accessory adaptors on a structural member as defined by claim 4, wherein:

said cantilevered portion defines a hook adapted to support at least one accessory.

6. The modular support assembly for retaining accessory adaptors on a structural member as defined by claim 2, wherein:

said inner periphery of said first and second clamp members and said channel are rectangular;

said mating protrusion defined by said shoe portion is adapted to be received in said channel.

7. The modular support assembly for retaining accessory adaptors on a structural member as defined by claim 1, wherein:

said cantilevered portion defines at least two pairs of approximately parallel elongated sections, each of said pairs defining a gap there between for retaining at least one pair of skis.

8. The modular support assembly for retaining accessory adaptors on a structural member as defined by claim 1, wherein:

said cantilevered portion defines a housing adapted to receive at least one electrical device operatively connected to an electrical power cord; and said housing includes a means for securing said housing to said structural member.

9. The modular support assembly for retaining accessory adaptors on a structural member as defined by claim 8, wherein:

said electrical device includes at least one electrical power outlet and light fixture.

10. The modular support assembly for retaining accessory adaptors on a structural member as defined by claim 8, wherein:

said means for securing includes at least one strap.

11. The modular support assembly for retaining accessory adaptors on a structural member is defined by claim 1, wherein:

said cantilevered portion includes a cabinet.

12. The modular support assembly for retaining accessory adaptors on a structural member as defined by claim 1, wherein:

said cantilevered portion defines at least two approximately parallel elongated sections, defining a gap there between, each of said elongated sections defining a plurality of raised and corresponding recessed portions for retaining one or more implements hung from said cantilevered portion.

13. The modular support assembly for retaining accessory adaptors on a structural member as defined by claim 12, wherein:

said shoe portion includes a collar portion, defining a groove, projecting therefrom; and each of said parallel elongated sections has an auxiliary support defining at least two edge portions, one of which seats in said groove to buttress said parallel elongated section.

14. The modular support assembly for retaining accessory adaptors on a structural member as defined by claim 13, wherein:

at least one of said two edge portions defines at least one aperture for accepting a hook used to support an accessory.

15. The modular support assembly for retaining accessory adaptors on a structural member as defined by claim 1, wherein:

said cantilevered portion defines a trough, said trough oriented approximately perpendicular to said structural member when said modular support assembly is adapted to be attached to said structural member, for retaining an accessory such as a hose.

16. The modular support assembly for retaining accessory adaptors on a structural member as defined by claim 15, wherein:

padding is adhered to at least one surface of said trough to protect said accessory.

17. The modular support assembly for retaining accessory adaptors on a structural member as defined by claim 1, wherein:

said shoe portion includes a downwardly projecting collar, defining a groove;

said support assembly further comprising a gusset adapted to be received in said groove, said gusset defining at least one tab coupled to an upper edge thereof; and a shelf having an upper and lower surface, said shelf defining at least one bracket extending from said lower surface, said bracket being adapted to slidably receive said tab, thereby releasably supporting said shelf on said gusset.

18. The modular support assembly for retaining accessory adaptors on a structural member as defined by claim 17, wherein:

said gusset having a lower edge having at least one aperture adapted to receive a hook for supporting an accessory.

19. A modular support assembly for retaining accessory adaptors on a structural member, comprising:

a base portion, including:

a first clamp member, defining at least two abutment surfaces, an inner peripheral surface, an outer peripheral surface, and at least one channel extending from said inner peripheral surface at least part-way through said first clamp member;

a second clamp member defining at least two abutment surfaces adapted to engage the abutment surfaces of said first lamp member, an outer peripheral surface, and an inner peripheral surface;

said accessory adaptor having a shoe portion and a cantilevered portion, said shoe portion defining at least one mating protrusion extending therefrom and adapted to be received in said channel;

first retaining means for clamping said first and second clamp members to said structural member, such that said abutment surfaces engage one another and said shoe portion is releasably retained in clamping engagement with said structural member;

first securing means for releasably securing an upper portion of a golf bag to said first clamp member;

a top portion, including:

a third clamp member, defining at least two abutment surfaces, an inner peripheral surface, and an outer peripheral surface;

a fourth clamp member, defining at least two abutment surfaces adapted to engage the abutment surfaces of said third clamp member, an outer peripheral surface, and an inner peripheral surface; and second retaining means for clamping said third and fourth clamp members to said structural member, such that said abutment surfaces engage one another in clamping engagement with said structural member; and second securing means for releasably securing a lower portion of said golf bag to said third clamp member.

20. A modular support assembly for supporting accessories on a structural member, comprising:

a first clamp member defining at least two abutment surfaces, an outer peripheral surface, and an inner peripheral surface, the inner peripheral surface defining means for receiving accessories to position the accessories substantially inwardly of the inner peripheral surface and against the structural member;

a second clamp member defining at least two abutment surfaces adapted to engage the abutment surfaces of said first clamp member, an outer peripheral surface and an inner peripheral surface; and retaining means for clamping said first and second clamp members to said structural member, such that said abutment surfaces engage one another in clamping engagement with said structural member to keep said accessories supported in a firmly fixed position against the structural member and such that said structural member and said accessories supported thereagainst are substantially interposed between the first and second clamp members.

21. A modular support assembly for supporting accessories on a structural member as defined by claim 20, wherein:

said retaining means includes at least one fastener extending through said second clamp member; and wherein said first clamp member defines at least one threaded aperture adapted to receive said fastener.

22. The modular support assembly for supporting accessories on a structural member as defined by claim 21, wherein:

said second clamp member defines two opposing bosses projecting outwardly from said outer peripheral surface, each of said bosses adapted to slidably receive one of said fasteners.

23. The modular support assembly for supporting accessories on a structural member as defined by claim 20, wherein:

said outer peripheral surface of said first clamp member further defines a cantilevered portion having a support rib formed integrally therewith.

* * * * *

UNITED STATES PATENT AND TRADEMARK OFFICE

CERTIFICATE OF CORRECTION

PATENT NO. : 6,095,466

DATED : August 1, 2000

INVENTOR(S) : Sener et al.

It is certified that error appears in the above-identified patent and that said Letters Patent is hereby corrected as shown below:

IN THE ABSTRACT

Line 7, after "first" please delete "claim" and insert --clamp--.

Signed and Sealed this

Nineteenth Day of December, 2000

*Attest:*

Q. TODD DICKINSON

*Attesting Officer*

*Commissioner of Patents and Trademarks*